United States Patent [19]

Braly

[11] 4,070,022

[45] Jan. 24, 1978

[54] MATCHED GOLF SHAFTS AND CLUBS

[75] Inventor: Joseph M. Braly, Kennett Square, Pa.

[73] Assignee: Con-Sole Golf Corporation, Kennett Square, Pa.

[21] Appl. No.: 676,905

[22] Filed: Apr. 14, 1976

[51] Int. Cl.[2] ..... A63B 53/12

[52] U.S. Cl. ..... 273/77 A; 273/80 B; 73/579

[58] Field of Search ..... 273/77 A, 80 R, 80 B; 73/67.2, 67.3

[56] References Cited

U.S. PATENT DOCUMENTS

| | | | |
|---|---|---|---|
| 1,516,786 | 11/1924 | Prentiss | 273/77 A |
| 1,594,801 | 8/1926 | Stackpole | 273/77 A |
| 2,349,736 | 5/1944 | Knobel et al. | 273/77 A X |
| 2,822,174 | 2/1958 | Brandon | 273/77 A X |
| 3,395,571 | 8/1968 | Murdoch | 273/77 A X |
| 3,473,370 | 10/1969 | Marciniak | 273/77 A X |
| 3,871,649 | 3/1975 | Kilshaw | 273/77 A |

OTHER PUBLICATIONS

"The Search for the Perfect Swing," by Cochran and Stobbs, 1968, p. 230.

"Kenneth Smith Golf Clubs," 1969, p. 5.

*Primary Examiner*—Richard J. Apley

*Attorney, Agent, or Firm*—Connolly and Hutz

[57] ABSTRACT

Method of producing matched golf clubs comprises steps of determining under similar conditions frequency of each golf club shaft of plurality of shafts. Shafts are selected from plurality such that frequencies thereof fall on predetermined gradient formed by plot of shaft frequency and shaft length. Frequency increments between successive shaft lengths along gradient are substantially equal. Subsequent mating of shafts with selected club heads produces integrated and correlated matched golf clubs. Matched set of shafts and clubs is also described.

7 Claims, 11 Drawing Figures

MATCHED GOLF SHAFTS AND CLUBS

BACKGROUND OF THE INVENTION

The present invention relates to the classification of golf club shafts in the production of matched sets of golf clubs, and more particularly to determining the frequency of individual golf club shafts and utilizing such frequency determinations to produce frequency modulated matched sets of golf clubs.

As presently manufactured, golf club sets are matched by utilizing static determinations including shaft length, overall club weight, swing weight, and manufacturer's designation of shaft flex. The flex of shaft is an arbitrary and relative designation and varies widely within specific flex designations. Generally, flex designation "X" stands for an extra stiff shaft, "S" for a stiff shaft, "R" for a regular shaft, "A" for a semiflexible shaft, and "L" for a lady or flexible shaft.

Many flex designations are determined by utilizing a flex board which measures statically the deflection of a shaft under the influence of a predetermined test weight secured to the tip end of a shaft anchored at the butt end. Actually, this procedure does not measure the flex or elasticity of the shaft which varies according to cross section, heat treating processes, metal composition and other factors. Hence, deflection is the only shaft characteristic measured by this procedure.

The flexibility of a golf club shaft plays a prime role in producing desirable golf shots. In connection with this role, it is believed desirable that during a golf shot the club shaft travel through a specific number of cycles of deflection from the start of the downswing of the club to the point of impact with the ball. Ultimately, when the club head contacts the ball, it is desirable that the shaft be in an undeflected position which positions the head at its point of maximum velocity. Hence, impact occurs at the point of maximum velocity of the club head which produces the ideal condition for a superior golf shot. Assuming the same swing or pass is placed on the club by the golfer, the flex of the shaft affects the golf shot as follows. If the shaft is too stiff, the club head ultimately passes through the point of maximum velocity prior to contacting the ball. Contact occurs later and the velocity of the club head at that point in time is substantially less. Conversely, if the shaft is too flexible, contact with the ball occurs prior to the club head reaching its maximum acceleration. In each instance, the distance of the golf shot is less than possible under ideal conditions of shaft flex.

U.S. Pat. No. 2,822,174, granted Feb. 4, 1958, relates to matched golf clubs including matched sets of golf club shafts. According to the disclosure, three essential factors of each shaft are correlated in predetermined manner throughout the woods and irons, and these factors include length of shaft, weight of shaft and shaft stiffness. However, the weight method of determining relative stiffness, as disclosed therein, is contrary to the instant invention.

SUMMARY OF THE INVENTION

Accordingly, an object of the present invention is to provide a unique method of producing frequency modulated matched golf clubs.

Another object of the present invention is to provide an efficient and relatively simple method of classifying golf clubs shafts based upon the frequency characteristics thereof.

Still another object of the present invention are integrated and correlated golf shafts and clubs.

In accordance with the present invention, a highly accurate method of producing matched golf clubs comprises the steps of determining under similar conditions the frequency of each golf club shaft of a plurality of shafts. Shafts are selected from the plurality so that the frequencies thereof fall on a predetermined gradient formed by a plot of shaft frequency and shaft length. Subsequent mating of the shafts with the selected club heads produces matched golf clubs.

Preferably, the frequency gradient of the various matched clubs is a substantially straight line that increases and the shaft length decreases. The frequency increments between successive shaft lengths along the gradient are substantially equal.

With club heads of the iron of wood type, the selection thereof includes first determining the weight of each club head of a plurality of heads. Club heads are then selected from the plurality so that the weights thereof fall on a predetermined gradient formed by a plot of head weight and club number. Such selection provides weight matched club heads for subsequent mating with matched golf club shafts in the production of matched golf clubs. Preferably, the gradient of club head weights is a substantially straight line that increases as the club number increases. The weight increments between successively numbered club heads are substantially equal.

The step of determining the frequency of each golf club shaft includes securing the butt end thereof in place at a stationary location and fastening a predetermined test weight at the tip end of the shaft. The shaft is then excited and the frequency thereof is determined by measuring the oscillations.

The present invention also involves a method of classifying golf clubs shafts comprising the steps of determining under similar conditions the frequency of each shaft selected from a group. The frequency determinations are then utilized as identifying characteristics of the shafts in the ultimate formation of matched golf clubs.

The present invention further involves matched golf club shafts comprising a series of shafts of varying length with each shaft having a different but predetermined frequency that falls on a predetermined gradient formed by a plot of shaft frequency and shaft length. The frequency increases as shaft length decreases. The matched golf club shafts may be combined with matched club heads such that each head has a predetermined weight whereby the weight of each head fails on a predetermined gradient formed by a plot of head weight and club number. The weight increases as the club number increases.

BRIEF DESCRIPTION OF THE DRAWINGS

Novel features and advantages of the present invention in addition to those mentioned above will become apparent to those skilled in the art from a reading of the following detailed description in conjunction with the accompanying drawing wherein similar reference characters refer to similar parts and in which.

DETAILED DESCRIPTION OF THE INVENTION

Figure 2:
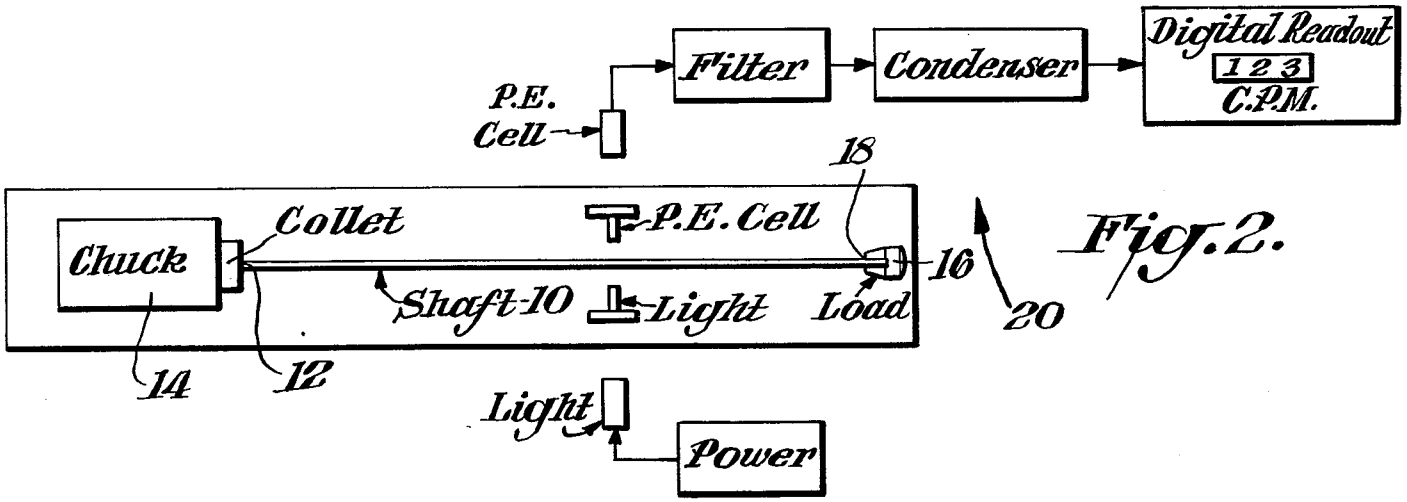
FIG. 2 is a diagrammatic top plan view of the apparatus shown in FIG. 1.
Figure 1:
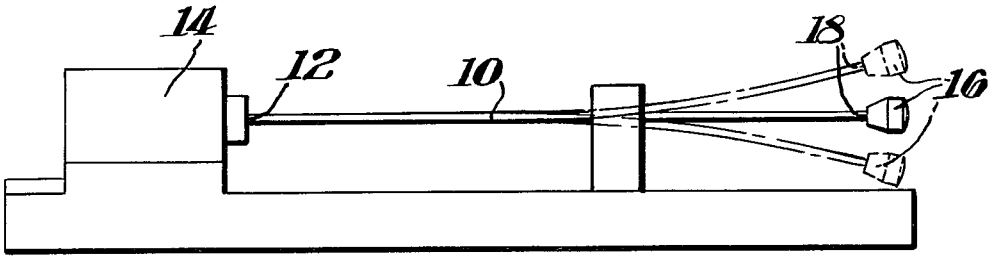
FIG. 1 is a diagrammatic front elevational view of apparatus for determining the frequency of a golf club or a golf club shaft.
Figure 3:
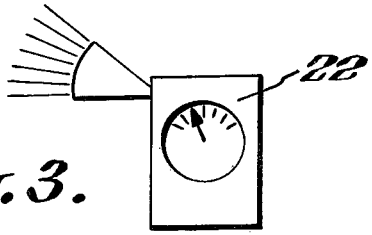
FIG. 3 diagrammatically illustrates alternate apparatus for determining the frequency of a golf club shaft mounted as in FIGS. 1 and 2.

Referring in more particularity to the drawing, FIGS. 1–3 illustrate a method for measuring the frequency of golf club shafts. Specifically, the method comprises the steps of determining under similar conditions the frequency of each golf club shaft 10 selected from a plurality of shafts. After the frequency determinations are made, shafts are selected from the plurality such that the frequencies of the selected shafts fall on a predetermined gradient formed by a plot of shaft frequency and shaft length. Subsequent mating of the shafts with weight matched club heads produces matched golf clubs. Also, the apparatus shown in FIGS. 1–3 is equally suitable for determining the frequency of assembled golf clubs, for reasons explained below.

The step determining the frequency of each shaft includes securing the butt end 12 of the shaft in place at a stationary location or chuck 14. A predetermined test weight 16 is fixed to the tip end 18 of the shaft after which the shaft is excited so that it oscillates. The test weight may be 250 to 300 grams, for example. The shaft oscillations are then measured utilizing the photoelectric counter unit 20, as best shown in FIG. 2. The details of the photoelectric counter unit 20 are common in the art and do not form any specific part of the present invention. In this regard, any convenient method of measuring the oscillations of the shaft during the frequency determination may be used. For example, FIG. 3 diagrammatically illustrates a stroboscope 22 for determining the frequency of the shaft upon excitation thereof. Other methods of identifying shaft frequency may be utilized according to the present invention as long as such other methods determine each shaft frequency under the same conditions as the others.

Figure 4:
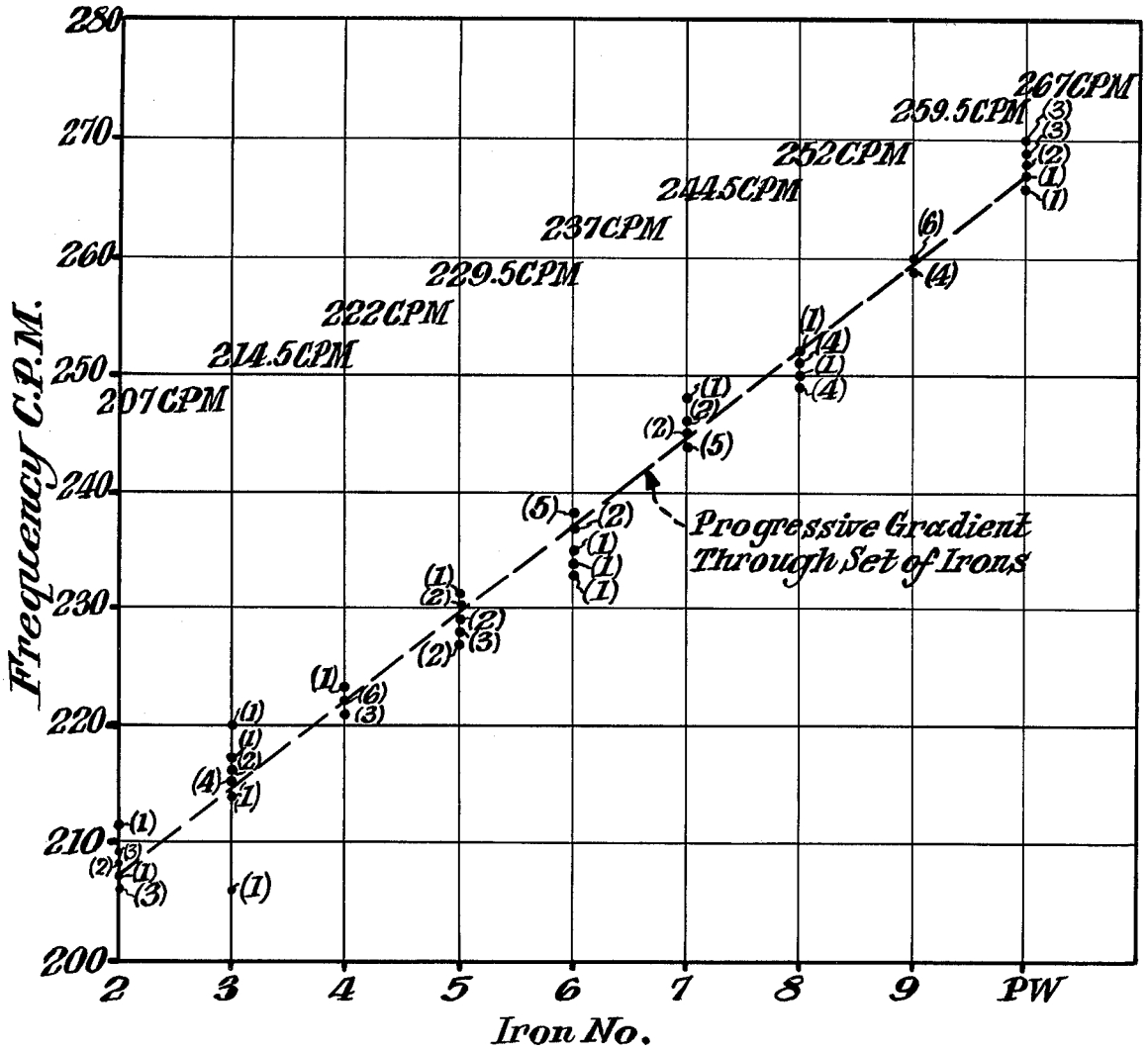
FIG. 4 is a plot of the frequency of ten sets of shafts.

Preferably, the frequency gradient is a substantially straight line that increases and the shaft length decreases. The frequency increments between successive shaft lengths along the gradient are substantially equal. FIG. 4 illustrates such a gradient determined by initially plotting the frequency of each shaft of ten sets. After these frequency determinations are plotted, as in FIG. 4, a straight line gradient is drawn such that it is representative of the recorded frequency information. Golf club shafts are then selected so that the frequencies of each shaft set fall on the gradient. At this point it should be noted that throughout the specification and claims reference is made to the condition that the shaft frequencies fall on a predetermined frequency gradient. This terminology is not intended to imply that each shaft frequency of a matched set falls directly on the gradient but instead to include frequencies close to the gradient by a factor of $\pm \frac{1}{2}$ cycles per minute.

Another aspect of the present invention is that while it is preferred that each predetermined frequency gradient be a substantially straight line, other gradients are also within the scope of the invention. In this regard, the frequency gradient of the matched golf club shafts may be slightly curved in either an upward or downward direction, for example, rather than straight.

Figure 5:
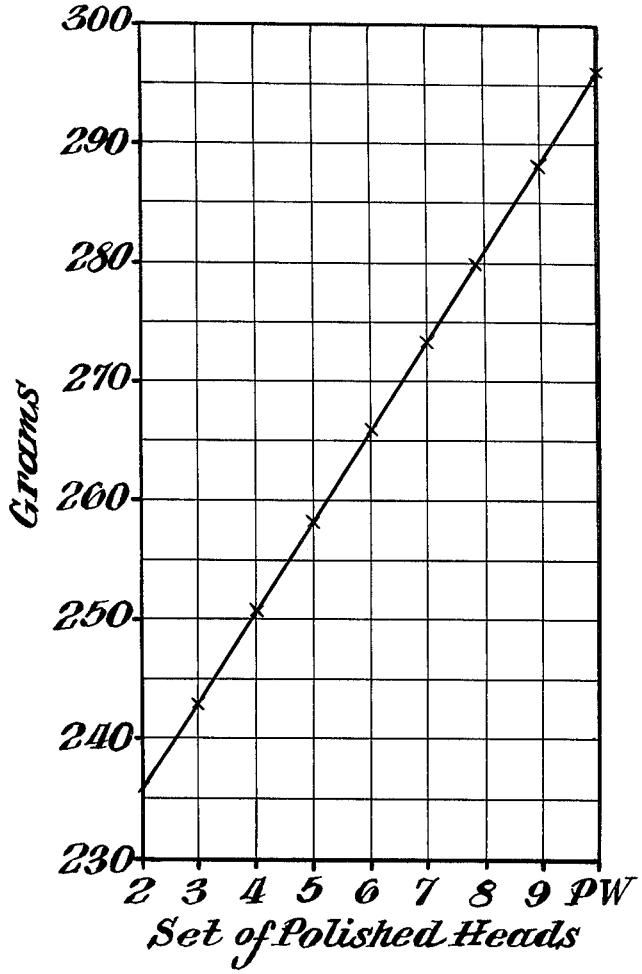
FIG. 5 is a plot of a weight matched set of golf club heads of the iron type.

As noted above, the present method of producing matched golf clubs includes securing selected club heads to the frequency matched shafts. In selecting club heads of the iron or wood type, the weight of each club head of a series is classified as to number and weight. Thereafter, club heads are selected such that the weights thereof fall on a predetermined gradient formed by a plot of head weight and club number. FIG. 5 illustrates a matched set of club heads, and the weight gradient thereof is shown as a straight line. The weight increments between successively numbered club heads are substantially equal. Here again, it is within the scope of the present invention that the weights fall on the predetermined gradient with a margin of error of $\pm \frac{1}{2}$ grams. While it is preferred that the weight gradient be substantially straight, and increase as the club number increases, the gradient may be slightly curved in an upward or downward direction and increase as the club number increases within the scope of the invention.

Figure 6:
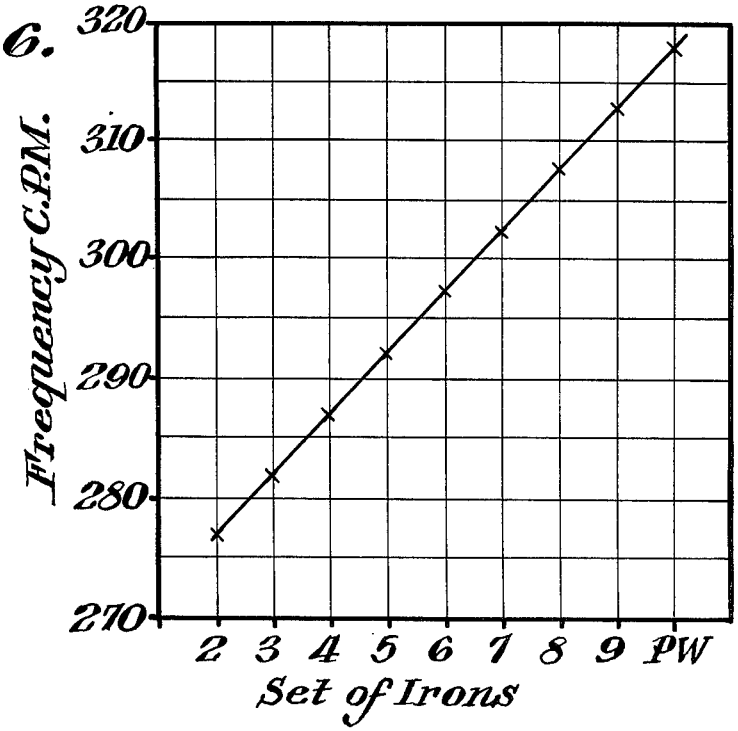
FIG. 6 is a plot of the frequency of a matched set of golf club irons.

FIG. 6 illustrates a matched set of golf clubs of the iron type which is the result of mating a frequency matched set of golf shafts with a weight matched set of club heads.

Figure 7:
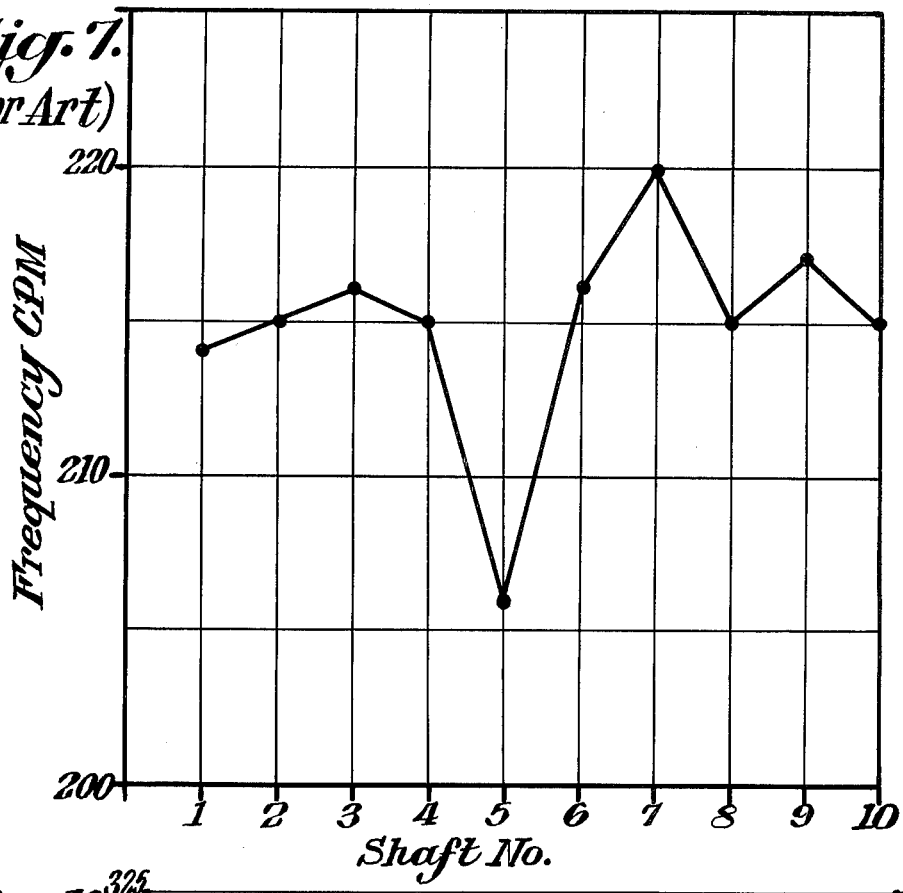
Fig. 7. (Prior Art)
FIG. 7 is a plot of the frequency of ten golf club shafts having the same shaft length and flex designation.

FIGS. 7–10 generally illustrate the prior art, and these plots are provided to show the significant differences between the prior art and the present invention. Specifically, FIG. 7 illustrates the frequency of ten shafts each having the same length and flex designation and also produced by the same source. As is readily evident, the fifth shaft tested has an extremely low frequency in comparison to the seventh shaft tested. Insofar as the manufacturer's designations are concerned, these shafts have identical characteristics. Frequency determinations reveal otherwise, and shaft number 7 is found to be much stiffer than average while number five is much more limber or flexible than average.

Figure 9:
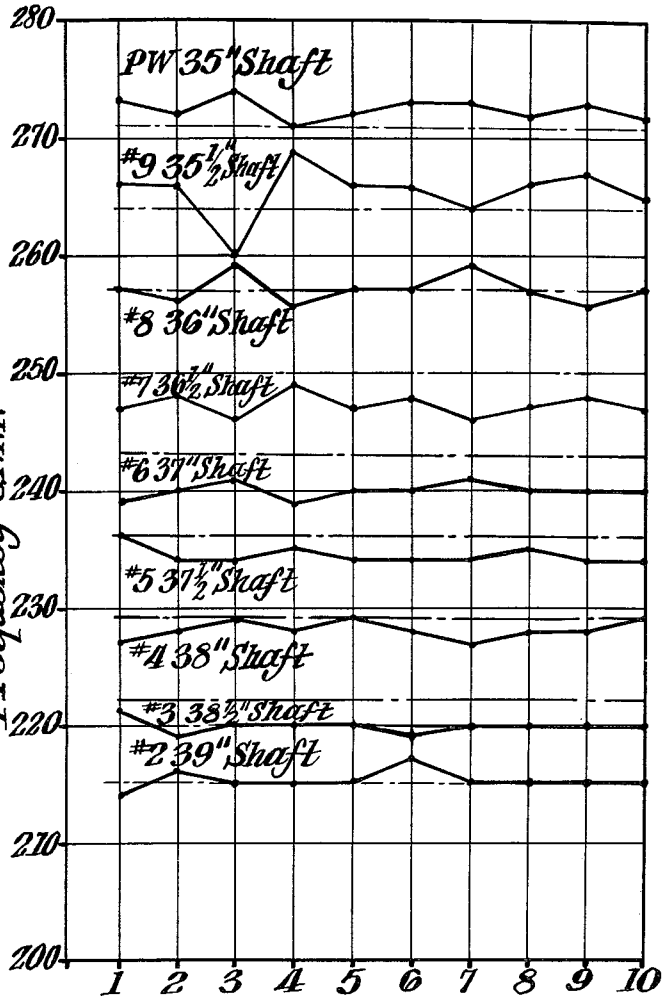
Fig. 9. (Prior Art)
FIGS. 8 and 9 are plots of the frequencies of ten sets of shafts having the same flex designation but manufactured by different sources.
Figure 8:
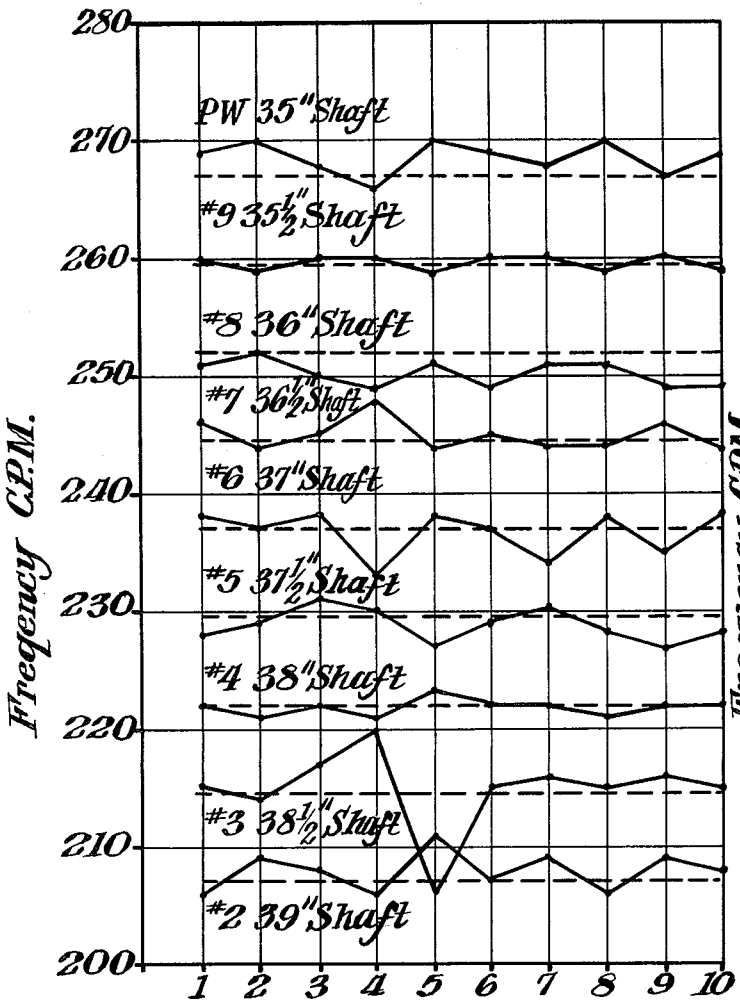
Fig. 8. (Prior Art)

FIGS. 8 and 9 each illustrate frequency plots of ten sets of shafts each having the same flex designation but produced from different sources. The dashed lines of FIG. 8 show the optimum frequency progression between each successive shaft of each set and the dash-dot lines of FIG. 9 illustrate a similar optimum progression. These plots graphically show the significant variations in golf club shafts of shafts otherwise identified as having identical characteristics.

Figure 10:
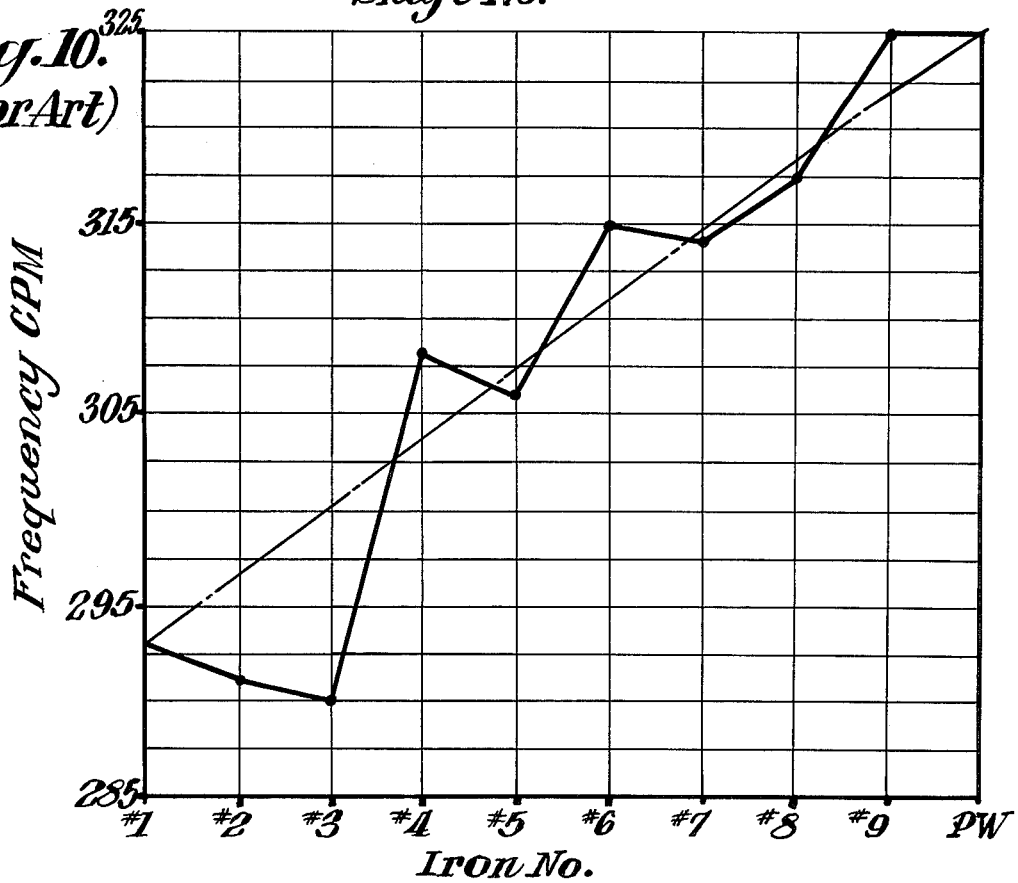
Fig. 10. (Prior Art)
FIG. 10 is a frequency plot of the golf club irons of one of the touring professionals.
Figure 11:
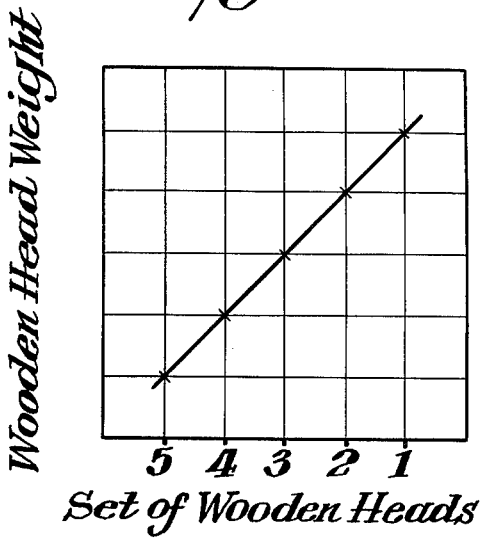
FIG. 11 is a plot of a weight matched set of golf club heads of the wood type.

Finally, FIG. 10 illustrates the frequency determinations of a set of irons used by one of the touring professionals. The straight line gradient simply interconnects the frequency of the one iron with the frequency of the pitching wedge. This plot dramatically illustrates how this particular set of clubs is basically mismatched. The three iron is much too flexible in comparison to the desired frequency along the gradient, and the four iron is too stiff. If a proper and uncompensated pass is placed on the three iron one would expect that the club head moves through its point of maximum velocity after making contact with the ball, for reasons explained above. On the other hand, a proper and uncompensated pass on the four iron results in club head contact with the ball after the head reaches its point of maximum velocity. Obviously, such conditions have an adverse affect upon the resultant golf shots.

According to the present invention, it is also seen that shaft length, shaft weight, center of gravity of shaft, flex of shaft, and mass of golf club head are integrated into a clearly definable integer, making possible the matching of a set of golf clubs based upon frequency determinations. These frequencies are modulated to conform to the requirements of the individual golfer.

Under actual conditions, most golf club shafts are received by club producers in lots of about 300 for each shaft length. Each of the 300 shafts of each length has the same flex designation. Utilizing the present invention, the frequency of each of the shafts is determined, and matched sets of shafts are then selected on the basis of a predetermined frequency gradient formed by a plot of shaft frequency and shaft length. Weight matched club heads are then secured to the matched shafts. The desired swing weight of the set is made by equally adjusting the weight of each of the heads prior to securing them to the shafts.

Shafts all having the same length are also used in the production of golf club sets. Here the shafts are individually cut to the desired length by the club manufacturer which eliminates the purchase of club shafts of varying lengths. Utilizing the present invention, the frequency of each of these shafts is determined prior to cutting them to the desired lengths. After the frequency determinations are made, the shafts are classified into groups of substantially the same frequency. The shafts needed for a golf club set are then selected from one of these groups after which such shafts are cut to the desired shaft lengths. Weight matched club heads are then secured to the matched shafts. The desired swing weight of the set is made by equally adjusting the weight of each of the heads prior to securing them to the shafts.

After the golf club sets are assembled, the frequency of each of the clubs thereof is determined to verify that the set is integrated and correlated within $\pm \frac{1}{2}$ cycles per minute. Such a frequency plot is shown in FIG. 6 of the drawing.

What is claimed is:

1. A method of producing matched golf clubs comprising the steps of establishing a predetermined frequency gradient formed by a plot of shaft frequency and shaft length such that the gradient is a substantially straight line that increases as shaft length decreases and the frequency increments between successive shaft lengths along the gradient are substantially equal, determining under similar conditions the frequency of each golf club shaft of a plurality of shafts at each given shaft length, selecting a shaft at each given shaft length whose frequency falls on the predetermined gradient, and securing selected club heads to the selected shafts.

2. A method of producing matched golf clubs as in claim 1 wherein the club heads are of the iron or wood type and the selection thereof includes determining the weight of each club head of a plurality of heads at each given club head number, and selecting heads from the plurality so that the weights thereof fall on a predetermined gradient formed by a plot of head weight and club head number.

3. A method of producing matched golf clubs as in claim 2 wherein the gradient of club head weights is substantially a straight line that increases as the club head number increases, and the weight increments between successively numbered club heads are substantially equal.

4. Matched golf club shafts comprising a series of at least four shafts of successive lengths, and each shaft of the series having a different but predetermined frequency that falls along a predetermined frequency gradient formed by a plot of shaft frequency and shaft length such that the gradient is a substantially straight line that increases as the shaft length decreases and the frequency increments between successive shaft lengths along the gradient are substantially equal.

5. Matched golf club shafts as in claim 4 wherein the series of shafts of varying length comprise a set of at least eight shafts of successive lengths.

6. Matched golf club shafts as in claim 5 in combination with matched club heads of the iron type, each head having predetermined weight such that the weight of each club head falls on a predetermined gradient formed by a plot of head weight and club number head, the gradient increasing as the club head number increases.

7. Matched golf club shafts as in claim 4 in combination with matched club heads of the wood type, each head having a predetermined weight such that the weight of each club head falls on a predetermined gradient formed by a plot of head weight and club number, the gradient increasing as the club head number increases.

* * * * *